US006156189A

United States Patent [19]

Ho et al.

[11] Patent Number: 6,156,189

[45] Date of Patent: Dec. 5, 2000

[54] OPERATING METHOD FOR FLUID CATALYTIC CRACKING INVOLVING ALTERNATING FEED INJECTION

[75] Inventors: Teh Chung Ho; Shun Chong Fung, both of Bridgewater; Daniel Paul Leta, Flemington, all of N.J.

[73] Assignee: Exxon Research and Engineering Company, Florham Park, N.J.

[21] Appl. No.: 09/294,951

[22] Filed: Apr. 20, 1999

Related U.S. Application Data

[63] Continuation-in-part of application No. 09/067,870, Apr. 28, 1997, abandoned.

[51] Int. Cl.[7] ..... C10G 11/00

[52] U.S. Cl. ..... 208/113; 208/120.01; 208/DIG. 1; 585/653

[58] Field of Search ..... 208/113, 120.01, 208/DIG. 1; 585/653

[56] References Cited

U.S. PATENT DOCUMENTS

| | | | |
|---|---|---|---|
| 3,424,672 | 1/1969 | Mitchell | 208/164 |
| 3,448,037 | 6/1969 | Bunn, Jr. et al. | 208/164 |
| 3,617,496 | 11/1971 | Bryson et al. | 208/80 |
| 3,781,533 | 12/1973 | Bamstone et al. | 235/150.01 |
| 3,799,864 | 3/1974 | Bunn et al. | 208/80 |
| 3,801,493 | 4/1974 | Youngblood et al. | 208/78 |
| 3,928,172 | 12/1975 | Davis, Jr. et al. | 208/77 |
| 3,993,556 | 11/1976 | Reynolds et al. | 208/75 |
| 4,620,920 | 11/1986 | Van Der Eijk et al. | 208/86 |
| 4,826,586 | 5/1989 | Herbst et al. | 208/70 |
| 4,927,522 | 5/1990 | Herbst et al. | 208/120 |
| 5,009,769 | 4/1991 | Goelzer | 208/113 |
| 5,098,554 | 3/1992 | Krishna et al. | 208/113 |
| 5,108,580 | 4/1992 | Nongbri et al. | 208/61 |
| 5,188,805 | 2/1993 | Sabottke | 422/411 |
| 5,298,155 | 3/1994 | Sabottke | 208/157 |
| 5,435,906 | 7/1995 | Johnson et al. | 208/78 |
| 5,565,176 | 10/1996 | Johnson et al. | 422/1.44 |
| 5,730,859 | 3/1998 | Johnson et al. | 208/78 |

FOREIGN PATENT DOCUMENTS

| | | |
|---|---|---|
| 0369536 | 5/1990 | European Pat. Off. . |
| 0382289 | 8/1990 | European Pat. Off. . |

OTHER PUBLICATIONS

J.E. Otterstedt, S.B. Gevert, S.G. Järås, and P.G. Menon, "Fluid Catalytic Cracking of Heavy (Residual) Oil Fractions: A Review", *Applied Catalysis*, 22 (1986) 159–179, Elsevier Science Publishers B.V. Amsterdam. No Month.

R. J. Glendinning, T.Y. Chan, and C.D. Fochtman, "Recent Advances in FCC Technology Maximize Unit Profitability" (AM–96–25), 1–17, presented at 1996 NPRA Annual Meeting, Mar. 17–19, 1996, San Antonio, Texas.

*Primary Examiner*—Walter D. Griffin
*Assistant Examiner*—Nadine Preisch
*Attorney, Agent, or Firm*—Estelle C. Bakun

[57] ABSTRACT

The present invention is directed to a Fluid Catalytic Cracking process conducted under fluid catalytic cracking conditions by injecting into at least one reaction zone of a fluid catalytic cracking unit (FCCU) having one or more risers, a plurality of feeds wherein said plurality of feeds comprises at least one feed (α) and at least another feed (β) wherein said feeds (α) and (β) (a) differ in Conradson Carbon Residue by at least about 2 wt % points; or (b) differ in hydrogen content by at least about 0.2 wt %; or (c) differ in API gravities by at least about 2 points; or (d) differ in nitrogen content by at least about 50 ppm; or (e) differ in carbon-to-hydrogen ratio by at least about 0.3; or (f) differ in mean boiling point by at least about 200° F; and wherein said feeds (α) and (β) are alternately injected and wherein said alternate injection maintains said risers in a cyclic steady state, while the rest of the FCC unit is in a steady state.

7 Claims, 3 Drawing Sheets

2a

2b

2c

OPERATING METHOD FOR FLUID CATALYTIC CRACKING INVOLVING ALTERNATING FEED INJECTION

CROSS REFERENCE TO RELATED APPLICATION

This is a Continuation-In-Part of U.S. Ser. No. 09/067,870, filed Apr. 28, 1998, now abandoned, and which is based upon Patent Memorandum 96CL-022.

FIELD OF THE INVENTION

This invention relates to Fluid Catalytic Cracking (FCC) for producing liquid fuels and light olefins from hydrocarbon mixtures such as petroleum fractions. More particularly, it relates to a nonlinear characteristic of the FCC process that leads to a novel FCC operating strategy for converting hydrocarbon mixtures.

BACKGROUND OF THE INVENTION

FCC has been, and will remain for quite some time, the primary conversion process in oil refining. In a typical present-day FCC process, a liquid feed mixture is atomized through a nozzle to form small droplets at the bottom of a riser. The droplets contact hot regenerated catalyst and are vaporized and cracked to lighter products and coke. The vaporized products rise through the riser. The catalyst is separated out from the hydrocarbon stream through cyclones. Once separated, the catalyst is stripped in a steam stripper of adsorbed hydrocarbons and then fed to a regenerator where coke is burned off. The products are sent to a fractionator for fractionation into several products. The catalyst, once regenerated, is then fed back into the riser. The riser-regenerator assembly is heat balanced in that heat generated by the coke burn is used for feed vaporization and cracking. The most common FCC feeds by far are gas oils or vacuum gas oils (VGO) which are hydrocarbon mixtures boiling above about 650° F. When refiners need to convert heavy, or highly contaminated oils such as resids, they usually blend a small amount of such heavy oils with the gas oil feeds. Due to a dwindling supply of high-quality crudes, the trend in the petroleum industry is that FCC will have to convert more and more heavy, dirty feeds. Such feeds contain a high level of contaminants such as nitrogen, sulfur, metals, polynuclear aromatics, and Conradson Carbon Residue (CCR, a measure of asphaltene content). Hereafter, the term heavy component is used to include such highly contaminated hydrocarbons as resids, deasphalted oils, lube extracts, tar sands, coal liquids, and the like. Such heavy components are added to other feeds containing less heavy components to obtain an FCC feed. These heavy components will become a significant portion of FCC feeds in years to come.

The technical problems encountered with FCC feeds containing heavy components have been reviewed by Otterstedt et al. (Otterstedt, J. E., Gevert, S. B., Jaras, S. G., and Menon, P. G., Applied Catalysis, 22, 159, 1986). Chief among them are high coke and gas yields, catalyst deactivation, and $SO_x$ in flue gas. The coke forming tendency of such heavy component-containing feeds has traditionally been gauged by their CCR content. VGO feeds typically contain less than 0.5 wt % CCR, whereas atmospheric and vacuum resids typically contain 1 to 15 wt % and 4 to 25 wt % CCR, respectively. Since cracking of such heavy components can produce coke levels far higher than that required by existing FCC units, the maximum permissible level of the heavy component in the FCC feed is often limited by the unit's coke burning capacity. Many FCC units today are capable of cracking only 5 to 15 wt % resid, or heavy component, in the feed. Due to feed cost considerations, there is a strong need for economical methods that can expand the FCC's operating envelope, that is, to be able to increase the heavy component limit within existing hardware constraints.

What is needed in the art is an FCC method which allows for increased use of alternative feeds and yield improvements for desired products via stretching the operating limits of existing hardware.

SUMMARY OF THE INVENTION

Applicants have found that the liquid yield in FCC does not degrade linearly, nor does the coke yield increase linearly, as the amount of heavy component in the feed increases. This means that the damaging marginal effect of feed contaminants on the FCC catalyst becomes increasingly weaker with increasing amounts of heavy components. Accordingly, the present invention discloses a new, improved FCC operating method for cracking feeds of differing quality.

Thus, the present invention is directed to a Fluid Catalytic Cracking process conducted under fluid catalytic cracking conditions comprising injecting into at least one reaction zone of a fluid catalytic cracking unit (FCCU) having one or more risers, a plurality of feeds wherein said plurality of feeds comprises at least one feed (α) and at least another feed (β) wherein said feeds (α) and (β) (a) differ in Conradson Carbon Residue by at least about 2 wt % points; or (b) differ in hydrogen content by at least about 0.2 wt %; or (c) differ in API gravities by at least about 2 points; or (d) differ in nitrogen content by at least about 50 ppm; or (e) differ in carbon-to-hydrogen ratio by at least about 0.3; or (f) differ in mean boiling point by at least about 200° F; and wherein said feeds (α) and (β) are alternately injected and wherein said alternate injection maintains said risers in a cyclic steady state, while the rest of the FCC unit is in a steady state. The cycle period for alternate injection is judiciously selected to maintain said risers in a cyclic steady state. Such cyclic operation can result in a higher time-average conversion and a lower coke selectivity compared to prior art, noncyclic operation. The benefit can translate into a higher heavy-component feed cracking capacity at constant liquid yield.

DETAILED DESCRIPTION OF THE INVENTION

Figure 1:
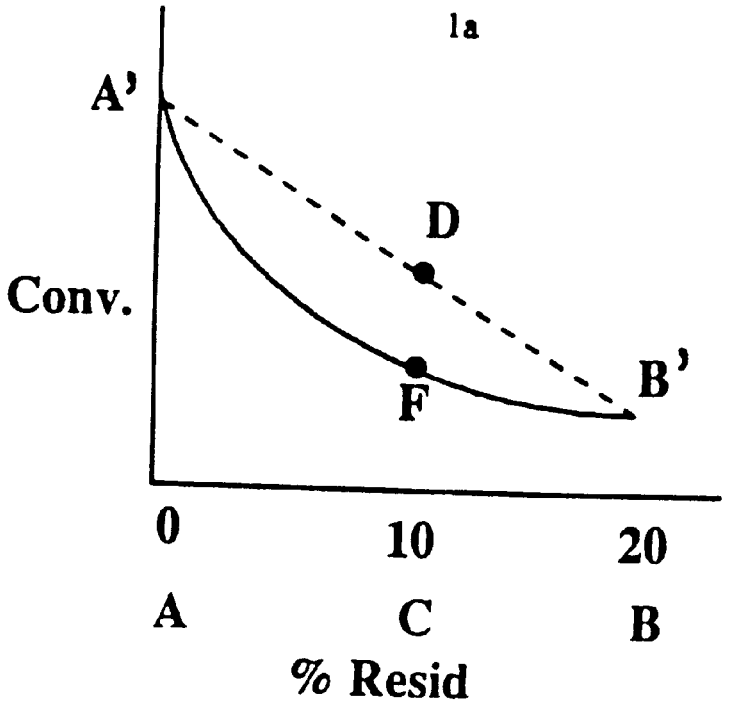
FIG. 1*a*: Conversion as a function of wt % resid in total feed.
FIG. 1*b*: Coke yield as a function of wt % resid in total feed.
Figure 1:
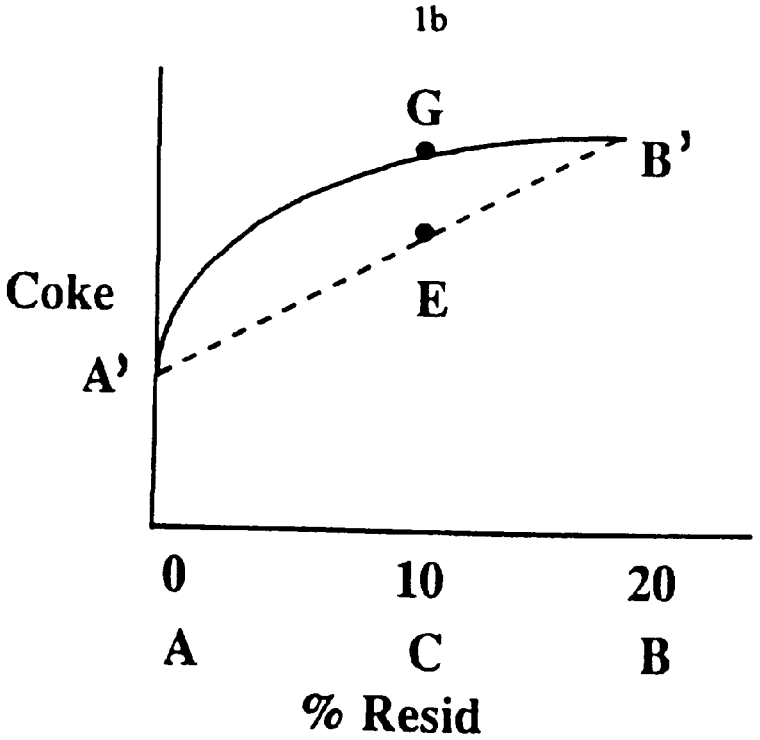

The invention is more easily understood from the Figures that can be readily obtained through routine laboratory and/or pilot plant experimentation. FIG. 1 depicts qualitatively the nonlinear dependencies of conversion and coke yield on the concentration of the resid in the feed. The curve for conversion is convex, whereas that for coke yield is concave. For instance, if an FCC unit's coke burning capacity is such that the maximum permissible concentration of the resid is 10 wt %, then the prior art teaches that it is cost effective to charge the unit with a feed containing 10 wt % resid in VGO, point C in FIG. 1*a*. For the above, the instant invention teaches a FCC operation that is entirely different from that taught by the prior art. Instead of keeping the heavy component at 10 wt % at all times, the instant invention calls for alternating the concentration of the heavy component between two levels: one is higher than 10 wt % resid and the other is lower. The cycle period (total combined time for injection of the two alternating feeds) is selected in such a way that it is long enough to maintain the FCCU riser in a cyclic steady state. Such a cycle period is necessarily short enough that the operation of other subsystems (fractionator, regenerator, and stripper) of the FCC unit are not disturbed. Thus, the other subsystems of the FCC unit are not affected to a degree that would impact the unit or process.

Figure 3:
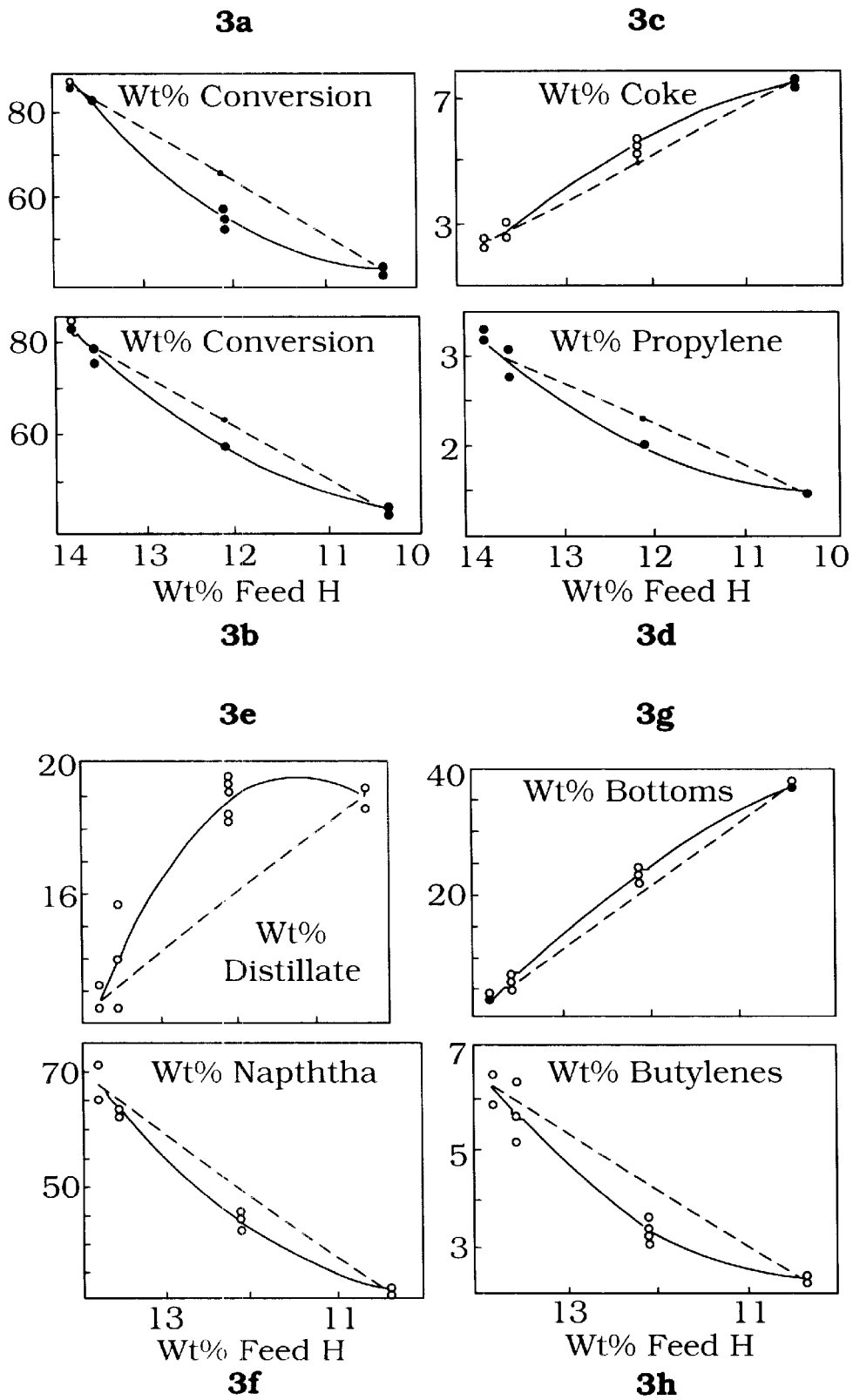
FIG. 3*a*: Conversion to <430° F. products vs. wt % feed hydrogen; 496° C., 6.5 C/O; catalyst A.
FIG. 3*b*: Conversion to <430° F. products vs. wt % feed hydrogen; 496° C., 6.5 C/O; catalyst B.
FIG. 3*c*: Coke yield vs. wt % feed hydrogen; 496° C., 6.5 C/O; catalyst C.
FIG. 3*d*: Propylene yield vs. wt % feed hydrogen; 496° C., 6.5 C/O; catalyst B.
FIG. 3*e*: Distillate yield vs. wt % feed hydrogen; 496° C., 6.5 C/O; catalyst C.
FIG. 3*f*: Naphtha yield vs. wt % feed hydrogen; 496° C., 6.5 C/O; catalyst C.
FIG. 3*g*: Bottoms yield vs. wt % feed hydrogen; 496° C., 6.5 C/O; catalyst C.
FIG. 3*h*: Butylene yield vs. wt % feed hydrogen; 496° C., 6.5 C/O; catalyst C.

Those skilled in the art would know, with reference to the instant invention, how to select the feeds utilizable in the instant invention. Essentially, the feeds are selected from the nonlinear curves of conversion and coke make versus a feed quality index such as wt % resid as shown in FIGS. 1*a* and 1*b*, or wt % feed hydrogen as shown in FIG. 3*b*. As stated earlier, such plots can be obtained a priori in small scale routine experiments. Knowing the FCC unit's resid capacity then helps the skilled artisan to select two feeds (α) and (β) for utilization in the instant invention. For example, if one predetermined that a 3% increase in liquid yield was desired, any two feeds which give the 3% increase [see, e.g., (D minus F) on FIG. 1*a* (D minus F) being the predetermined increase desired] would be selected. Preferably, the increase in liquid yield will be at least about 0.5 wt % on feed, and/or the decrease in coke make will be at least about 0.2 wt % on feed. The wt % decrease in coke make would be represented by G minus E on FIG. 1*b*. By selecting two such feeds, the blend of the liquid products from alternately cracking the two feeds (D) is higher than that which could be achieved if the two feeds were first mixed and then cracked (F). Note that any feed quality index can be used to generate the plots, e.g., % resid, hydrogen content, API gravity, nitrogen content, C/H ratio, boiling point, to name a few. Typically, at least three feeds will be used to generate the plots.

Referring to FIG. 1*a*, one example of the invention is to cycle the concentration of the heavy component between 0 and 20 wt % (points A and B in FIG. 1) with equal time interval. In another embodiment, the concentration can be cycled between 5 and 15 wt %. In either case, the time average resid concentration is 10 wt %. However, as FIG. 1 shows, the alternating operation gives a higher time average conversion (point D in FIG. 1*a*) and a lower time average coke yield (point E in FIG. 1*b*) than the prior art, nonalternating (uniform feed injection) operation (points F and G) with a feed containing 10 wt % of the heavy component. FIGS. 1*a* and 1*b* also imply that the greater the difference in the quality of the two feed components (for instance, gas oil vs. vacuum resid), the larger the benefit (lower coke make and increased liquid yield). The benefit stems from the non-linearity shown in FIG. 1. That is, the loss caused by the heavy component-containing feed is more than offset by the gain caused by the other feed. The heavy component-containing feed is highly contaminated with CCR, nitrogen, polynuclear aromatics, and/or metals. They are also characterized by low hydrogen content or low API gravity.

Applicants believe that the reason the instant invention can maintain the FCC operation in a cyclic steady state is due to the wide disparity in the response times of various FCC subsystems to external disturbances. Owing to its short contact time and near plug flow, the riser has a very short response time, typically on the order of 5 seconds. The regenerator is much more sluggish, with response time typically on the order of 30 minutes. The response times of stripper and fractionator are also orders of magnitude longer than that of the riser. If, for example, each of the two feeds is injected for 20 seconds (that is, the cycle period is 40 seconds), then the riser can quickly equilibrate itself to a new steady state long before the subsequent feed switch. Thus, the riser is essentially operated between two steady states. The riser is referred to as being in a cyclic steady state. On the other hand, the 40 second cycle period is too short for the sluggish regenerator to respond. The fluctuations caused by feed cycling will be quickly smoothed out, and the regenerator basically is in a steady state. The same is true for the stripper and fractionator. For instance, the liquid holdup, heavy vapor-liquid traffic, and reflux in the fractionator would quickly damp out any high frequency fluctuations.

Hence, one skilled in the art could readily select a cycle period at which the FCC unit operates as if there were two risers for individual cracking of two feeds of different quality. The feed switching for practical purposes is imperceptible to the regenerator, stripper, and fractionator.

The preferred feed cycle period may be symmetrical where each feed is fed for the same amount of time, or asymmetrical where the feeds are fed for different periods of time.

The feed cycle times are readily selected by the skilled artisan based upon the response times of the risers, regenerator, and fractionator. Selection should preferably be based upon the longest time permitted by the regenerator operation and product recovery considerations.

Thus, the instant invention offers many choices in both feed considerations. While the above example alternates two feeds with equal time intervals, this symmetric mode of feed switching may not necessarily give the maximum benefit. In some cases, asymmetric switching may be preferred; that is, each feed is injected for a different amount of time. For instance, in the above example where the cycle period is 40 seconds, the individual periods for the straight VGO and 20 wt %-resid-in-VGO feeds may be 15 and 25 seconds, respectively. The feed concentrations of the heavy component used in the instant operation may also be chosen for maximum benefit. One may also use different flow rates for the two feeds. Thus, the instant operation offers many degrees of freedom for process optimization. Typical cycle times can range from 10 seconds to 3 minutes, preferably, 20 seconds to 2 minutes. The FCCU is operated by continuously repeating each cycle.

Those skilled in the art would immediately see that for a given conversion or coke yield, the instant operation translates into a higher capacity for the FCC unit to convert the heavy component of the feed. The process of the instant invention is run at FCC conditions known to those skilled in the art.

Although the foregoing is discussed in the context of heavy feed cracking, those skilled in the art would also immediately see that the instant operation can be applied to any feed pair whenever the feed properties are sufficiently different. For instance, for maximum olefin production, the feed pair may comprise a naphtha-rich stock and naphtha-lean stock. Nonlimiting examples of feed property yardsticks for suitable feeds are (a) hydrogen content (differing by at least about 0.2 wt %), (b) carbon-to-hydrogen ratio (differing by at least about 0.3), (c) API gravity (differing by at least about 2 points), (d) nitrogen content (differing by at least about 50 ppm), (e) mean boiling point (differing by at least about 200° F.), (f) a CCR (differing by at least about 2 wt %), etc. Preferably, only two feeds will be utilized.

Applicants believe that the benefits of the instant invention originate from the convex and concave behaviors illustrated in FIGS. 1*a* and 1*b*. Accordingly, the following illustrative, nonlimiting examples were obtained in experiments aimed at establishing the convex and concave responses to changes in heavy feed component level for various feedstocks, catalysts, and cracking conditions. It should be noted that while FIG. 1 uses the wt % resid-in-feed as the measure of the feed heavy component level, other measures can also be used, for instance, CCR, hydrogen, nitrogen, polars plus multi-ring aromatics, to name a few.

While the instant invention method can be used for any two feeds whose qualities [(a) to (f)] are sufficiently different, it is particularly suited for converting heavy, low quality hydrocarbon mixtures. It gives a higher time-average liquid yield and a lower time average coke make than those obtained from prior art, nonalternating operations. Additionally, in many cases, a higher time average propylene yield than that obtained in nonalternating operation can be obtained. The present method can be implemented in different cracking reactor configurations, including but not limited to short contact time risers, fluidized reactors, and downflow reactors.

In the case where an FCC unit is equipped with two risers or one riser having segregated reaction zones, the invention can also be practiced with greater than two feeds. By segregated is meant physically separated or spatially separated at a distance effectively yielding two separate reaction zones. For example, when three feeds of decreasing quality (as defined by (a) to (f), for example) or crackability $\alpha$, $\beta$ and $\gamma$, respectively, are at the refiner's disposal, feeds $\alpha$ and $\beta$ can be alternately injected into the first riser and feeds $\alpha$ and $\gamma$ alternately injected into the second riser in accordance with the feed selection criteria [(a) to (f)] hereinbefore discussed. The products from each riser may then be combined. Additionally, any combination of the three feeds where two feeds are alternately injected into each riser can be utilized. For example, in one riser with two reaction zones, $\alpha$ and $\beta$ can be alternately injected into one reaction zone and $\alpha$ and $\gamma$ into the second reaction zone. Additionally, $\alpha$ and $\beta$ can be alternately injected into one reaction zone of a first riser and $\alpha$ and $\gamma$ can be injected into separate reaction zones of the same riser or into a second riser as follows: (i) simultaneously injecting into a single reaction zone of a single riser feed ($\alpha$) from at least one injection nozzle of said riser and feed ($\gamma$) from the remaining nozzles of the riser; or (ii) simultaneously injecting feed ($\alpha$) into at least one reaction zone of a second riser and feed ($\gamma$) into another reaction zone of the second riser of the FCCU. As can be seen, many possible combinations are possible. Preferably, in such a case, the cleanest, most crackable feed will be injected into each riser along with one of the two remaining feeds in each alternating riser. By cleanest, most crackable feed is meant that feed having the highest hydrogen content, or the highest API or the lowest nitrogen content, the lowest carbon-to-hydrogen ratio or the lowest mean boiling point or lowest CCR as compared to the other two feeds. The criteria for the feeds are that the two feeds injected into the same riser must meet the criteria previously described herein [(a) to (f)]. Namely, the feeds injected into the same riser must (a) have CCR differing by at least 2 wt % points; or (b) differ in hydrogen content by at least about 0.2 wt %; or (c) differ in API gravities by at least about 2 points; or (d) differ in nitrogen content by at least about 50 ppm; or (e) differ in carbon-to-hydrogen ratio by at least about 0.3; or (f) differ in mean boiling point by at least about 200° F.

In all the examples given below, the desired nonlinear behaviors were observed.

EXAMPLE 1

For this series of experiments, a pure VGO and two feed blends comprising a VGO and a vacuum resid (VR) were prepared, one containing 16 wt % resid, the other 32 wt %. Table 1 lists the properties of the feed blends in terms of their CCR (wt %) and indigenous nitrogen (wppm) levels. An equilibrium catalyst impregnated with 3500 ppm Ni was used.

TABLE 1

PROPERTIES OF FEED BLENDS

| VR/VGO, wt % / wt % | CCR | N, ppm |
|---|---|---|
| 0/100 | 0.26 | 1181 |
| 16/84 | 2 | 1524 |
| 32/68 | 4.2 | 1852 |

The cracking experiments were conducted in an FCC pilot unit at 515° C. and a catalyst-to-oil (C/O) ratio of 8. During the run, the catalyst is metered from a regenerated catalyst hopper into a riser using a screw feeder. The hot catalyst contacts incoming oil and gaseous nitrogen and is carried up the riser where the oil is cracked. At the end of the riser, the spent catalyst and reactor products enter a separation zone. Here the gases continue overhead to a product recovery system and the catalyst drops down a stripper and into a spent catalyst hopper. The gaseous products are cooled to produce a $C_5^+$ liquid product and a $C_5^-$ product gas.

Since cracking follows second-order kinetics, a measure of the extent of cracking is the so-called kinetic conversion $\xi$. Denoting $X_{430}$ as the weight percent conversion to the <430° F. product on a coke-free basis, then $\xi_{430}=X_{430}/(100-X_{430})$. The coke selectivity S is calculated by $S=Y/\xi_{430}$ where Y is the weight percent coke yield on feed. Let the percent conversions of the straight VGO and 32% VR-in-VGO feeds be $X_1$ and $X_2$, respectively. Their time-average kinetic conversion is then $\bar{\xi}=(X_1+X_2)/2/[100-(X_1+X_2)/2]$, and the corresponding time-average coke selectivity is $\bar{S}=(Y_1+Y_2)/2/\xi$.

Figure 2:
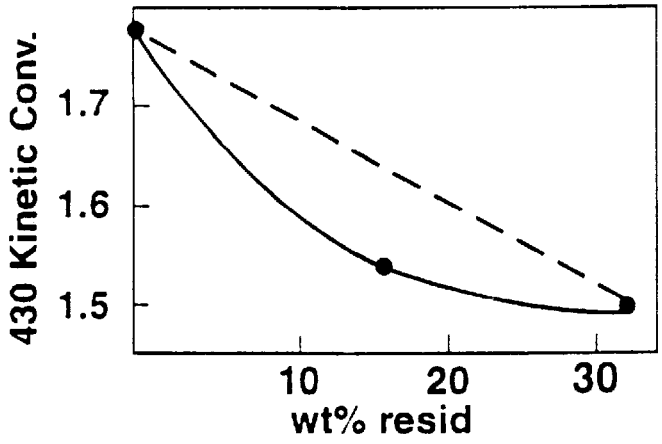
FIG. 2*a*: Coke-free kinetic conversion to <430° F. products vs. wt % resid in feed; 515° C., 8 C/O.
FIG. 2*b*: Coke-free kinetic conversion to <650° F. products vs. wt % resid in feed; 515° C., 8 C/O.
FIG. 2*c*: Coke selectivity vs. wt % resid in feed; 515° C., 8 C/O.
Figure 2:
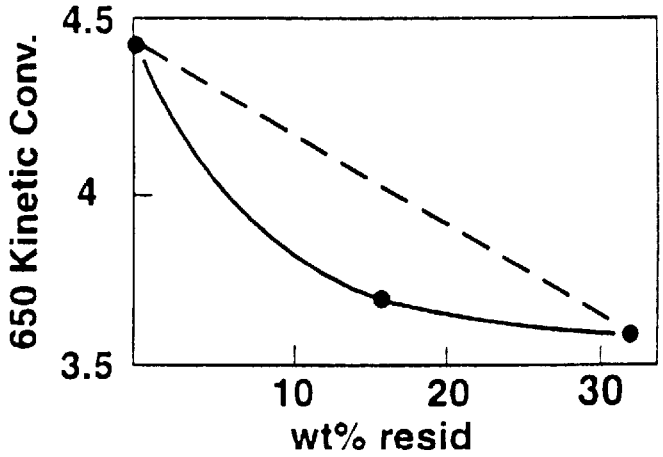
Figure 2:
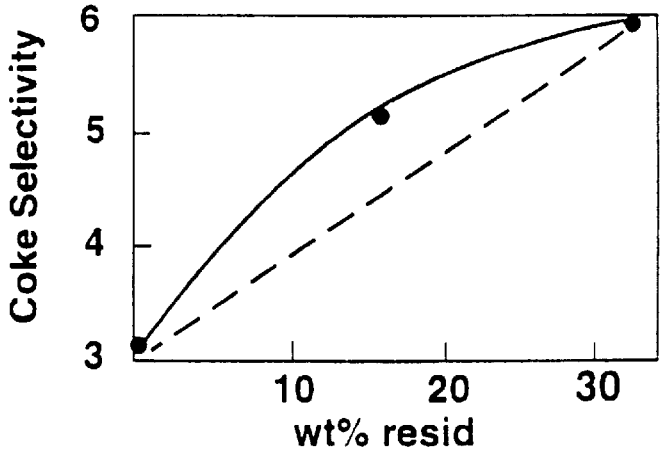

FIGS. 2*a* and 2*b* show, respectively, the coke-free kinetic conversions to <430° F. and <650° F. products as functions of the resid content of the total feed. FIG. 2*c* depicts a similar plot for coke yield. From these plots one can determine the time average kinetic conversion and coke selectivity. It follows from FIGS. 2*a* to 2*c* that $\bar{\xi}$ (for conversions to <430° F. and <650° F. products) are higher than those obtained from the 16% VR-in-VGO feed, while $\bar{S}$ is lower. Each data point is the average of two or three runs. Specifically, the 430 and 650 coke-free kinetic conversions were improved by 5.3% and 7.5%, respectively. That is, in the case of 430 coke-free conversion, the ratio of $\bar{\xi}$ to $\xi$ (for the 16% VR-in-VGO feed) is 1.053. And the coke selectivity is lowered by 12.2%.

EXAMPLE 2

The above experiment was repeated at a C/O of 5. It was observed that the 430 and 650 kinetic conversions increased by 10.2% and 11.7%, respectively. Moreover, the coke selectivity is lowered by 9.3%.

EXAMPLE 3

The experiment described in Example 2 was repeated at 560° C. and a C/O of 5. In this case, the 430 and 650 kinetic conversions were improved by 3.7% and 4.9%, respectively. And the coke selectivity is lowered by 21.5%.

EXAMPLE 4

In this case, the catalyst was the same as in Example 1 except that it was not impregnated with Ni. Cracking conditions are 5 C/O and 515° C. The 430 and 650 kinetic conversions were improved by 8.9% and 10.7%, respectively, with the coke selectivity being decreased by 4.4%. The propylene yield was improved by 6.5%.

EXAMPLE 5

The feed components used in this example are a hydrotreated VGO (HTGO) and a butane-deasphalted resid (DAO). Table 2 lists the compositions and properties of the feed blends.

TABLE 2

PROPERTIES OF FEED BLENDS

| DAO/HTGO, wt % / wt % | CCR | N, ppm |
|---|---|---|
| 0/100 | 0.17 | 541 |
| 20/80 | 1.6 | 1030 |
| 40/60 | 3.0 | 1519 |

The cracking experiments were run at 530° C. and 8 C/O over an equilibrium catalyst different from that used in Example 4. The 430 and 650 kinetic conversions were increased by 4.9% and 10.8%, respectively. The coke selectivity is decreased by 7.4%.

EXAMPLE 6

A vacuum gas oil was separated into different fractions having varying hydrogen contents via solvent extraction. These resulting fractions were each cracked at 496° C., 6.5 C/O, and 80 g/m oil rate over several commercial catalysts, designated as catalysts A, B, and C. Table 3 lists the properties of these catalysts. The hydrogen content of the feed was used as the feed quality measure. The data shown in FIGS. 3*a* to 3*h* were obtained for feeds whose hydrogen contents are 10.4, 12.1, 13.6, and 13.8 wt %. The results shown in the Figures clearly show the desired nonlinear effects.

TABLE 3

CATALYST PROPERTIES

| CATALYST | SURFACE AREA, $m^2/g$ | UNIT CELL, Å |
|---|---|---|
| A | 154 | 24.24 |
| B | 84 | 24.34 |
| C | 80 | 24.38 |

What is claimed is:

1. A Fluid Catalytic Cracking process conducted under fluid catalytic cracking conditions comprising injecting into at least one reaction zone of a fluid catalytic cracking unit (FCCU) having one or more risers, a plurality of feeds wherein said plurality of feeds comprises at least one feed (α) and at least another feed (β) wherein said feeds (α) and (β) (a) differ in Conradson Carbon Residue by at least about 2 wt % points; or (b) differ in hydrogen content by at least about 0.2 wt %; or (c) differ in API gravities by at least about 2 points; or (d) differ in nitrogen content by at least about 50 ppm; or (e) differ in carbon-to-hydrogen ratio by at least about 0.3; or (f) differ in mean boiling point by at least about 200° .; and wherein said feeds (α) and (β) are alternately injected and wherein said alternate injection maintains said risers in a cyclic steady state, while the rest of the FCC unit is in a steady state.

2. The process of claim 1 wherein the combined amount of time for injecting feeds (α) and (β) (cycle time) ranges from about 10 seconds to about 3 minutes.

3. The process of claim 2 wherein said cycle time ranges from about 20 seconds to about 2 minutes.

4. The process of claim 1 wherein liquid yield is increased and coke make is decreased by increasing the difference in the quality of said feeds (α) and (β) as measured by (a), (b), (c), (d), (e) or (f).

5. The process of claim 1 wherein said feeds (α) and (β) are injected at the same or different flow rates.

6. The process of claim 1 wherein when said FCC unit has at least two risers or one riser with at least two segregated reaction zones, at least one additional feed (γ) is alternately injected into at least one of said risers or one of said segregated reaction zones with either feed (α) or (β) and wherein said feed (γ) compared to the feed it is being injected with has (a) a CCR differing by at least 2 wt % points; or (b) differs in hydrogen content by at least about 0.2 wt %; or (c) differs in API gravities by at least about 2 points; or (d) differs in nitrogen content by at least about 50 ppm; or (e) differs in carbon-to-hydrogen ratio by at least about 0.3 or (f) differs in mean boiling point by at least about 200° F. compared to the feed it is being injected with.

7. The process of claim 6 wherein said feed (α), (β) or (γ) with the lowest conradson carbon, highest hydrogen content, highest API, lowest C:H ratio, lowest nitrogen content, or lowest mean boiling point is alternately injected into each of said two risers, or each of said segregated reaction zones along with one of said remaining feeds.

* * * * *